US008137133B2

(12) United States Patent
Malak

(10) Patent No.: US 8,137,133 B2
(45) Date of Patent: Mar. 20, 2012

(54) MICRO ENCAPSULATION SEAL FOR COAXIAL CABLE CONNECTORS AND METHOD OF USE THEREOF

(75) Inventor: Stephen P. Malak, Manlius, NY (US)

(73) Assignee: John Mezzalingua Associates, Inc., East Syracuse, NY (US)

( * ) Notice: Subject to any disclaimer, the term of this patent is extended or adjusted under 35 U.S.C. 154(b) by 0 days.

(21) Appl. No.: 12/916,513

(22) Filed: Oct. 30, 2010

(65) Prior Publication Data

US 2011/0124222 A1 May 26, 2011

Related U.S. Application Data

(62) Division of application No. 12/488,744, filed on Jun. 22, 2009, now Pat. No. 7,828,596.

(51) Int. Cl.
*H01R 9/05* (2006.01)

(52) U.S. Cl. ..... 439/578

(58) Field of Classification Search ..... 439/578, 439/936, 589, 275, 874, 276
See application file for complete search history.

(56) References Cited

U.S. PATENT DOCUMENTS

| | | | | |
|---|---|---|---|---|
| 3,654,577 | A | 4/1972 | Spinner et al. | |
| 3,818,120 | A | 6/1974 | Spinner | |
| 4,299,434 | A | 11/1981 | Ishikawa | |
| 4,536,524 | A | 8/1985 | Hart et al. | |
| 4,940,852 | A | 7/1990 | Chernack | |
| 5,073,129 | A | 12/1991 | Szegda | |
| 5,470,257 | A | 11/1995 | Szegda | |
| 5,510,405 | A | 4/1996 | Heucher et al. | |
| 5,941,736 | A | 8/1999 | Murakami | |
| 6,148,513 | A | 11/2000 | Schiefer et al. | |
| 7,018,235 | B1 * | 3/2006 | Burris et al. | 439/584 |
| 7,331,820 | B2 | 2/2008 | Burris et al. | |
| 7,828,596 | B2 | 11/2010 | Malak | |

FOREIGN PATENT DOCUMENTS

DE 3741510 A1 7/1988

* cited by examiner

*Primary Examiner* — Javaid Nasri
(74) *Attorney, Agent, or Firm* — Schmeiser, Olsen & Watts; Melissa S. Bitting

(57) ABSTRACT

A coaxial cable connector comprising a connector body, a tubular inner post configured to receive a coaxial cable and a clamping member, whereby at least one surface of the coaxial cable connector is coated with microcapsules creating an adhesive material. An adhesive layer is pre-applied to defined components of the coaxial cable connector in their pre-assembled configuration to avoid increased labor for the connector installer and to ensure a minimal but uniform layer of the microencapsulated adhesive is present on the desired connector components. When the coaxial cable is inserted into and clamped within the coaxial cable connector, the microcapsules are ruptured by the resulting pressure. This results in an adhesive bond forming between the coaxial cable and the connector to create a secure, mechanical bond and moisture seal.

3 Claims, 4 Drawing Sheets

MICRO ENCAPSULATION SEAL FOR COAXIAL CABLE CONNECTORS AND METHOD OF USE THEREOF

CROSS-REFERENCE TO RELATED APPLICATIONS

This application is a divisional application claiming priority from U.S. patent application Ser. No. 12/488,744, filed Jun. 22, 2009, now U.S. Pat. No. 7,828,596 issued Nov. 9, 2010; the disclosure of which is herein incorporated by reference.

FIELD OF THE INVENTION

This invention relates generally to coaxial cable connectors. More particularly, the present invention relates to a microencapsulation seal for coaxial cable connectors and a related method of use.

BACKGROUND OF THE INVENTION

Conventional coaxial cable typically consists of a centrally located inner electrical conductor surrounded by and spaced inwardly from an outer cylindrical electrical conductor. The inner and outer conductors are separated by a dielectric insulating sleeve, and the outer conductor is encased within a protective dielectric jacket. The outer conductor can comprise a sheath of fine braided metallic strands, a metallic foil, or multiple layer combinations of either or both.

Conventional coaxial cable connectors typically include an inner cylindrical post configured for insertion into a suitably prepared end of the cable between the dielectric insulating sleeve and the outer conductor, an end portion of the latter having been exposed and folded back over the outer dielectric jacket. The inner conductor and the dielectric insulating sleeve thus comprise a central core portion of the cable received axially in the inner post, whereas the outer conductor and dielectric jacket comprise an annular outer portion of the cable surrounding the inner post. An example may be seen in U.S. Pat. No. 5,470,257 (Szegda).

Conventional coaxial cable connectors further include an outer component designed to coact with the inner post in securely and sealingly clamping the annular outer portion of the cable therebetween. In "crimp type" connectors, as disclosed in U.S. Pat. No. 5,073,129 (Szegda), the outer component comprises a sleeve fixed in relation to and designed to be deformed radially inwardly towards the inner post. In "radial compression type" connectors, as disclosed in U.S. Pat. No. 5,470,257 (Szegda), the outer component comprises a substantially non-deformable sleeve adapted to be shifted axially with respect to the inner post into a clamped position coacting with the inner post to clamp the prepared cable end therebetween.

Because coaxial cable connectors consist of multiple parts, water and/or water vapor are able to penetrate through small holes in the connector created between the inner portion and outer portion of the connector as well as between the connector and the coaxial cable. The introduction of water and/or water vapor to the inside of a coaxial cable connector can cause destruction of the inside of the coaxial cable connector resulting in lower performance and the eventual need to replace the connector. Similarly, other corrosive vapors can cause destruction by entering the coaxial cable connector through tiny holes between the inner and outer portions of the connector as well as between the connector and the coaxial cable.

In the past, attempts have been made to fix this problem by injecting materials into the connectors to fill these small holes and prevent moisture from entering the coaxial cable connectors. In U.S. Pat. No. 3,654,577 (Spinner et al), an attempt to address this problem was made by injecting the hollow portions of a waveguide terminator with a viscous elastic material to prevent the moisture from entering the terminator through its outer surfaces tiny holes. U.S. Pat. No. 3,818,120 (Spinner) also addressed this problem using the injection method to prevent moisture from entering a coaxial plug connector by filling the holes of the outer surface with a self-curing synthetic resin. Finally, U.S. Pat. No. 5,510,405 (Heucher et al) addressed this problem by injecting a hot-melt type adhesive into coaxial cable connectors to seal the connector and prevent moisture from entering.

These injection methods have been successful in preventing moisture damage, however they have also created additional problems within the connectors. One such problem is the inability to control where the injected material goes once inside the connector, thereby damaging other components of the connector. In addition the injected material could seep out of other holes in the connectors and create problems for the installer. The injection method also makes installation more difficult because it requires the installer to use additional materials and tools to perform the installation. Difficult installation is unfavorable because coaxial cable connectors are often installed in towers located high off the ground.

Another method used in the past to prevent moisture from entering connectors involves protection of the inner pin of the connector from inside of the connector body. In U.S. Pat. No. 4,299,434 (Ishikawa), an attempt was made to address the moisture problem in connectors by mounting elastomeric layers within a watertight RF coaxial jack connector. The elastomeric layers were mounted within the connector body to protect the split pin, thus protecting against destruction of the connector. This method could still result in moisture coming into contact with the pin and destroying the connector if there were any deformities in the elastomeric layers. Even the slightest crack or hole would be enough to enable water to enter the connector and cause damage. In addition, this method requires additional components to be manufactured as well as an additional step in the assembly process, resulting in a more expensive connector.

Attempts have also been made to solve the moisture problem by placing bonding materials onto the different components of connectors just prior to installation, which react during installation to create a moisture seal. In U.S. Pat. No. 6,148,513 (Schiefer et al), a sealing material is placed on at least two components of the connector prior to installation, whereupon the sealing material reacts causing its volume to enlarge and fill the hollow spaces between the contact part and conductor and the contact part and the sheath during installation. The sealing material creates a moisture barrier to prevent damage to the connector. As with some of the other methods of creating a moisture seal, this method also requires that the installer apply the sealing materials just prior to installation. This requires the installer to carry extra materials and tools with him/her and makes the installation process more difficult.

Finally, others have attempted to solve the moisture problem in electrical connectors using microcapsules containing an adhesive solution. In U.S. Pat. No. 5,941,736 (Murakami), a microcapsule layer containing an adhesive solution is used to create a liquid tight seal within electrical wire connectors. Upon rupture of this microcapsule layer the adhesive solution is released and enables the housing and connection terminals of the connector to be joined and form a liquid tight seal. The adhesive solution is used to prevent oil from leaking out into the rest of the connector body.

The present invention utilizes microencapsulation adhesives. Typical microencapsulation adhesives are seen in U.S. Pat. No. 4,536,524 (Hart et al) and U.S. Pat. No. 4,940,852 (Chernack). The '524 patent is for a microencapsulated epoxy adhesive system which can be used to form an adhesive bond between two components. The '852 patent is for a liquid microencapsulated adhesive layer which can also be used to join two components. A microencapsulated adhesive is envisioned for the present invention to form the adhesive seal and locking action between the defined components of the coaxial cable connector. The make up of the adhesive prevents moisture both in liquid and vapor form from entering the coaxial cable connector.

Accordingly, a new way to keep liquids and moisture out of coaxial cable connectors while simultaneously developing a mechanical seal to inseparably lock the connector components is necessary to reduce the frequency of connector replacement and to reduce the costs and labor involved with the current methods of creating moisture seals for coaxial cable connectors. An adhesive layer is pre-applied to defined components of the coaxial cable connector in their pre-assembled configuration to avoid increased labor for the connector installer and to ensure a minimal but uniform layer of the microencapsulated adhesive is present on the desired connector components.

SUMMARY OF THE INVENTION

The invention is an adhesive layer that simultaneously creates a moisture seal and mechanical connection between defined components of the coaxial cable connector. A first aspect of the invention includes a coaxial cable connector having a connector body with a connector body internal passageway defined therein, the connector body further comprising a tubular inner post disposed within the connector body internal passageway, the tubular inner post extending from a first post end to a second post end; an outer collar surrounding and fixed relative to the tubular inner post at a location disposed rearwardly of the second post end, the outer collar defining an internal collar passageway cooperating in a radially spaced relationship with the tubular inner post to define and annular chamber; and an adhesive layer comprising microcapsules of an adhesive material on a portion of the internal collar passageway.

A second aspect of the invention includes a compression member for a coaxial cable connector having a first compression member end and a second compression member end, the compression member having a compression member internal passageway defined therein, the compression member internal passageway configured to receive a coaxial cable, the compression member further having an adhesive layer comprising microcapsules of an adhesive material.

A third aspect of the invention includes a compression member for a coaxial cable connector having a first compression member end and a second compression member end, the compression member having a compression member external surface defined thereon, the compression member external surface further having an adhesive layer comprising microcapsules of an adhesive material.

A fourth aspect of the invention includes a coaxial cable connector for coupling an end of a coaxial cable, the coaxial cable having a dielectric surrounding a center conductor, a conductive grounding sheath surrounding the dielectric and a protective outer layer surrounding the conductive grounding sheath, the connector comprising: a connector body having a first connector body end and a second connector body end, the connector body having a connector body internal passageway defined therein, the first connector body end having a first connector body internal diameter; a compression member having a first compression member end and a second compression member end, the compression member further having a compression member internal passageway defined therein, the first compression member end having an outer surface configured for insertion into the first connector body internal diameter; and, a first adhesive layer comprising microcapsules of an adhesive material on a portion of the compression member internal passageway.

A fifth aspect of the invention includes a coaxial cable connector for coupling an end of a coaxial cable, the coaxial cable having a dielectric surrounding a center conductor, a conductive grounding sheath surrounding the dielectric and a protective outer layer surrounding the conductive grounding sheath, the connector comprising: a connector body having a first connector body end and a second connector body end, the connector body having a connector body internal passageway defined therein, the first connector body end defining a first connector body outer diameter; a compression member having a first compression member end and a second compression member end, the compression member further having a compression member internal passageway defined therein, the first compression member end defining a first compression member inner diameter, wherein the first connector body outer diameter is configured for insertion into the first compression member inner diameter; and, a first adhesive layer comprising microcapsules of an adhesive material on a portion of an outer surface of the connector body.

This invention also includes a method for creating a mechanically sealed moisture barrier between a coaxial cable connector and the outer sheath of a prepared end of a coaxial cable, where the connector is comprised of a coaxial cable connector body and a compression ring, and an adhesive layer comprising microcapsules. The method consists of the following steps: (1) applying the adhesive layer to at least one surface of the connector body and/or compression ring; (2) preparing the coaxial cable; (3) inserting the coaxial cable into the connector; and (4) compressing the connector to rupture the microcapsules of the adhesive layer.

DESCRIPTION OF THE PREFERRED EMBODIMENT(S)

Figure 1:
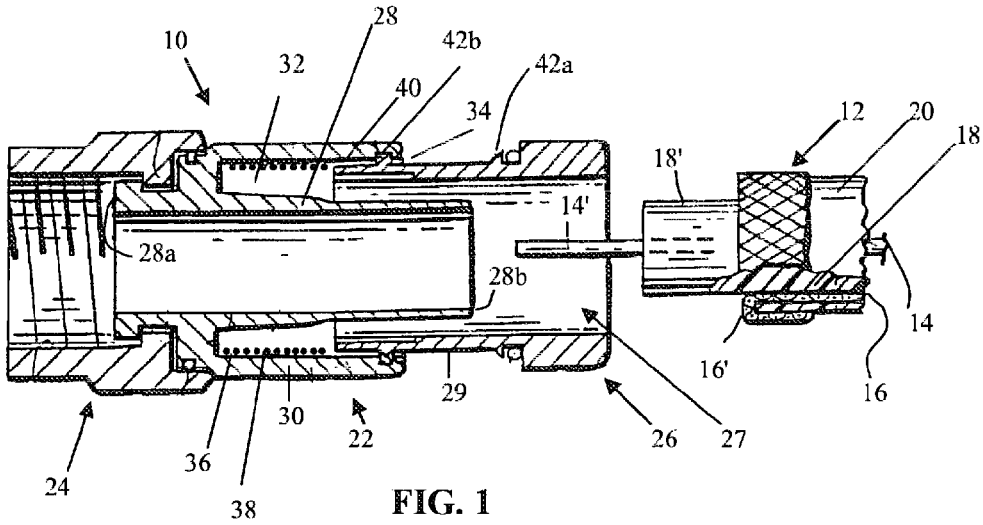
FIG. 1 depicts a cross-sectional view of a coaxial cable connector with an adhesive layer (shown in stipple) on an inner surface of a connector body and shown adjacent to the prepared end of a coaxial cable.
Figure 2:
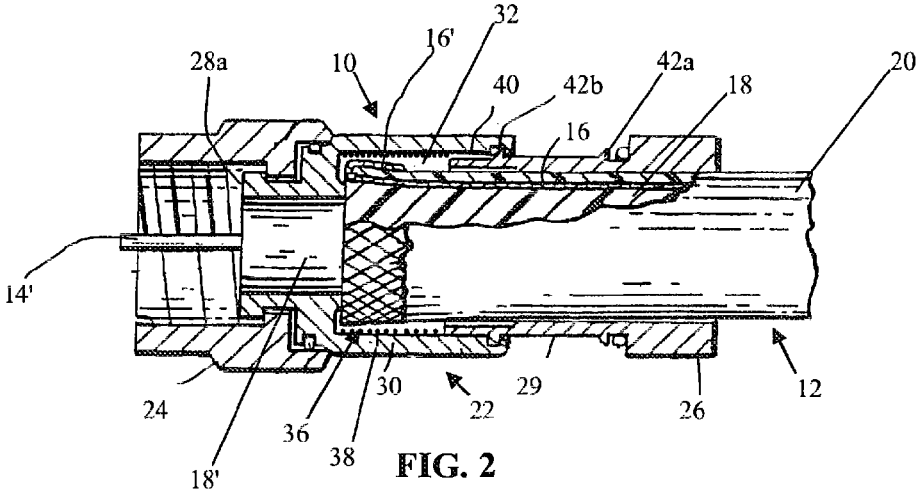
FIG. 2 depicts the coaxial cable connector of FIG. 1 where the coaxial cable has been inserted into the connector, but prior to clamping the cable within the connector.
Figure 3:
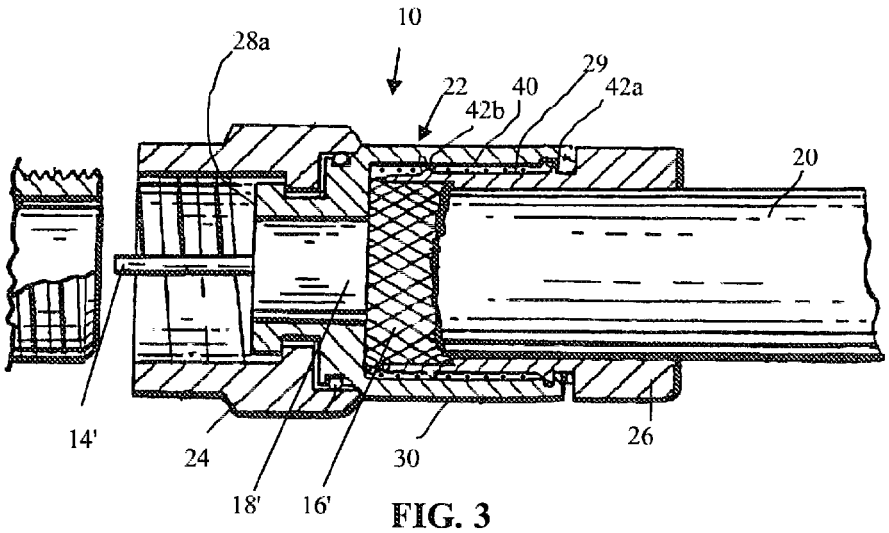
FIG. 3 depicts the coaxial cable connector of FIG. 1 where the coaxial cable has been inserted into the connector and clamped within the connector.

Referring initially to FIGS. 1-3, a coaxial cable connector in accordance with the present invention is generally depicted at 10 adjacent to the prepared end of a coaxial cable 12. Cable 12 is of a known type comprising an electrical inner conductor 14 surrounded by and spaced radially inwardly from an outer conductor 16 by a dielectric insulating sleeve 18. The outer conductor 16 can comprise a sheath of fine braided metallic strands, a metallic foil, or multiple layer combinations of either or both. A dielectric covering or jacket 20 surrounds the outer conductor 16 and comprises the outermost layer of the cable.

An end of the cable is prepared to receive the coaxial cable connector 10 by selectively removing various layers to progressively expose an end 14' of the inner conductor, an end 18' of the insulating sleeve, and an end portion 16' of the outer conductor folded over the insulating jacket 20.

Coaxial cable connector 10 includes a connector body 22, a cylindrical fastener 24 and a compression member 26. Connector body 22 comprises a tubular inner post 28 extending from a front end 28*a* to a rear end 28*b*, and an outer cylindrical collar 30 surrounding and fixed relative to the inner post 28 at a location disposed rearwardly of the front end 28. Outer cylindrical collar 30 cooperates in a radially spaced relationship with the inner post 28 to define an annular chamber 32 accessible via a rear opening 34. In a first embodiment, an adhesive layer 36, located on an inner surface 40 of outer cylindrical collar 30, includes microcapsules 38 (shown in stipple) of an adhesive material. Adhesive layer 36 extends around the circumference of inner surface 40 of outer cylindrical collar 30 and along a length of inner surface 40 that can vary depending on the degree of mechanical bonding action desired once the compression member 26 is advanced into connector body 22, at which time the microcapsules 38 of adhesive layer 36 are ruptured to form a bond between the connector body 22 and compression member 26.

Figure 4:
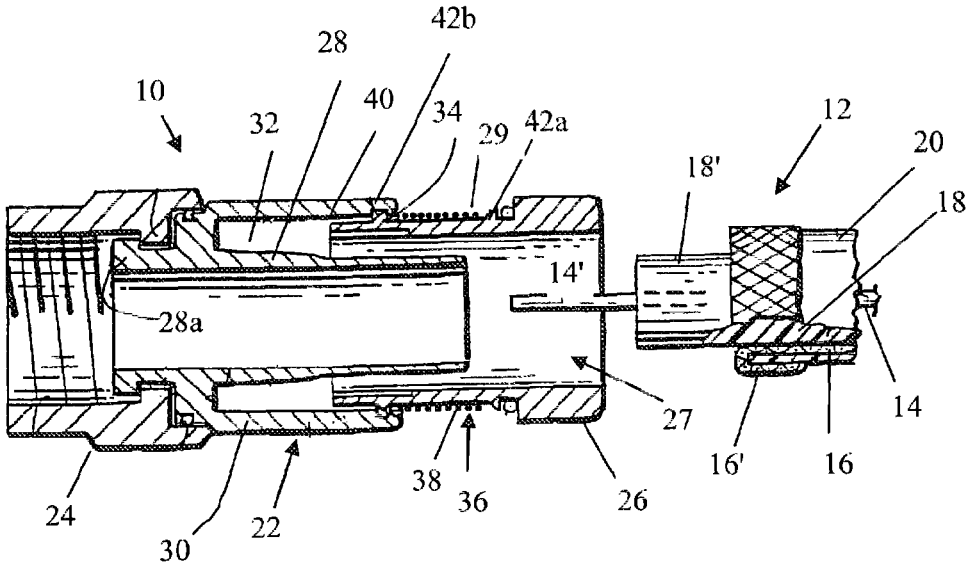
FIG. 4 depicts a cross-sectional view of a coaxial cable connector with an adhesive layer (shown in stipple) on an outer surface of a compression member.
Figure 5:
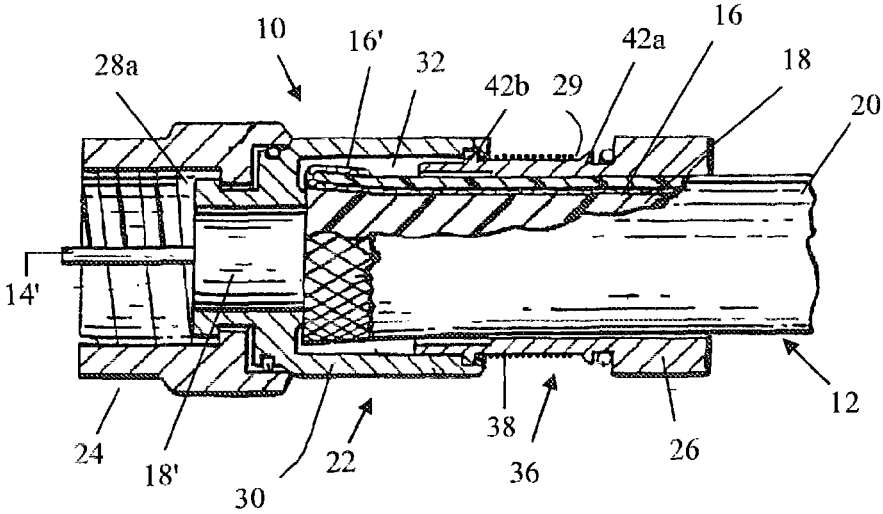
FIG. 5 depicts the coaxial cable connector of FIG. 4 where the coaxial cable has been inserted into the connector, but prior to clamping the cable within the connector.
Figure 6:
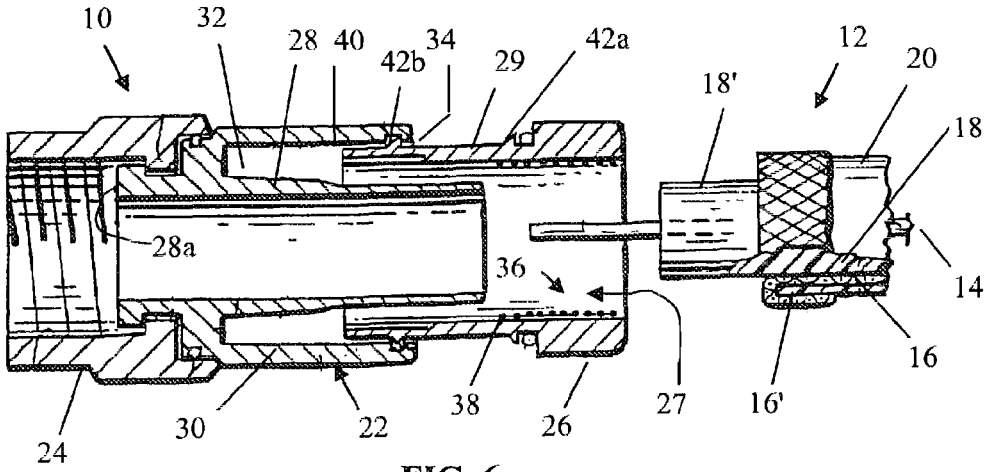
FIG. 6 depicts a cross-sectional view of a coaxial cable connector with an adhesive layer (shown in stipple) on a compression member internal passageway and shown adjacent to the prepared end of a coaxial cable.
Figure 7:
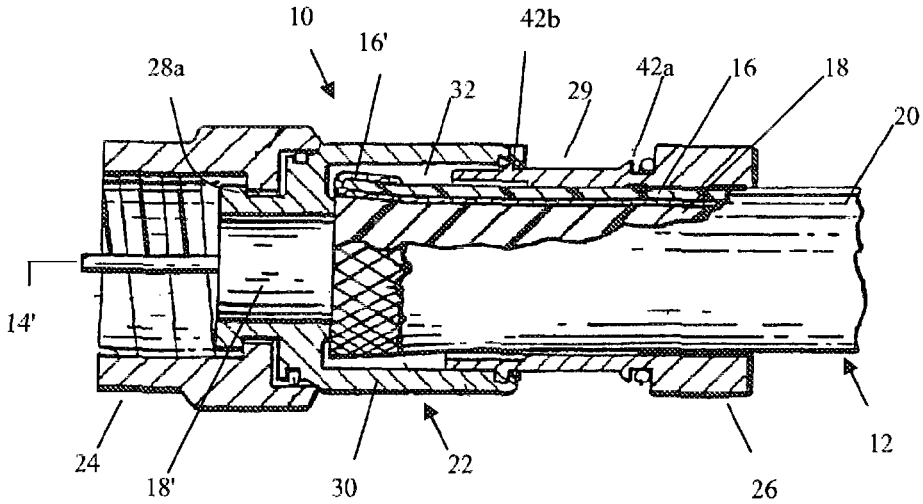
FIG. 7 depicts the coaxial cable connector of FIG. 6 where the coaxial cable has been inserted into the connector, but prior to clamping the cable within the connector.

Coaxial cable connector 10 further includes a compression member 26 having a compression member internal passageway 27. Compression member 26 is configured to protrude axially through rear opening 34 into the annular chamber 32. Engagement means, preferably first and second axially spaced radially protruding circular shoulders 50*a* and 50*b*, serve to integrally couple the compression member 26 to the connector body 22 between a first "open" position as seen in FIG. 1 and a second "clamped" position as shown in FIG. 3. In a second embodiment, as shown in FIGS. 4-5, an adhesive layer 36 (shown in stipple), located on an outer surface 29 of the compression member 26, includes microcapsules 38 of an adhesive layer. Adhesive layer 36 extends around the circumference of outer surface 29 and along a length of surface 29 that can vary depending on the degree of mechanical locking action desired between the connector body 22 and the compression member 26. In a third embodiment, as shown in FIGS. 6-7, an adhesive layer 36, located within the compression member internal passageway 27, includes microcapsules 38 of an adhesive layer 36 (shown in stipple). Adhesive layer 36 extends around the circumference of compression member internal passageway 27 and along a length of passageway 27 that can vary depending upon the degree of mechanical bonding action desired between the insulating jacket 20 and compression member 26.

The adhesive layer 36 is composed of microcapsules 38 that contain an adhesive material. The adhesive material is composed of an epoxy resin and a curing agent. When the epoxy resin and curing agent are separated by microencapsulation they do not react. Microcapsules 38 contain both microcapsules of epoxy resin and microcapsules of curing agent, which can be ruptured upon the application of sufficient pressure. Microcapsules may be configured to rupture upon the application of varying pressures. Once the microcapsules 38 are ruptured the epoxy resin and curing agent are released and react to create the adhesive material forming both a mechanical bond and a moisture barrier.

When installing the coaxial cable connector 10 on the prepared end of coaxial cable 12, the tubular inner post rear end 28*b* is first inserted axially into the cable end. Any contact of the coaxial cable 12 with the inner surface 40 of outer cylindrical collar 30 is minimal and the microcapsules 38 of adhesive layer 36 remain intact. As shown in FIG. 3, when the compression member 26 is compressed within connector body 22, outer surface 29 of the compression ring 26 comes into contact with inner surface 40 of outer cylindrical collar 30 with sufficient pressure to rupture the microcapsules 38 of adhesive layer 36. The ruptured microcapsules 38 interact to form an inseparable bond between connector body 22 and compression ring 26, thereby creating a mechanical connection and a moisture barrier.

A second embodiment of this invention can be seen in FIGS. 4 and 5. FIG. 4 shows an adhesive layer 36 of microcapsules 38 (in stipple) located on a portion of outer surface 29 of compression member 26. As shown in FIG. 5, when installing coaxial cable connector 10 on the prepared end of coaxial cable 12, the tubular inner post rear end 28*b* is first inserted axially into the cable end. Similar to FIG. 3, when the compression member 26 is compressed within connector body 22, the outer surface 29 of compression member 26 comes into contact with inner surface 40 of outer cylindrical collar 30 with sufficient pressure to rupture the microcapsules 38 of adhesive layer 36. The ruptured microcapsules 38 interact to form a bond between connector body 22 and compression member 26, thereby creating a mechanical connection and a moisture barrier.

FIGS. 6 and 7 show a third embodiment of this invention. FIG. 6 shows the adhesive layer 36 of microcapsules 38 (shown in stipple) located on a portion of compression member internal passageway 27. As shown in FIG. 7, when installing coaxial cable connector 10 on the prepared end of coaxial cable 12, the tubular inner post rear end 28*b* is first inserted axially into the cable end. In this instance, a microcapsule configured to rupture at a lower applied pressure may be used so that as coaxial cable 12 is inserted into compression member internal passageway 27, microcapsules 38 of adhesive layer 36 are easily ruptured. Similar to FIG. 3, when the compression member 26 is compressed within connector body 22, the ruptured microcapsules 38 form a bond between compression member 26 and coaxial cable 12, thereby creating a mechanical connection and a moisture barrier.

Figure 8:
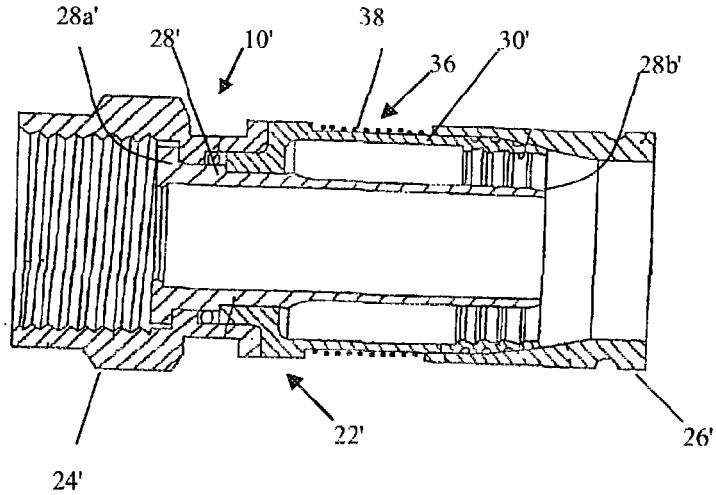
FIG. 8 depicts a cross-sectional view of a coaxial cable connector with an adhesive layer (shown in stipple) on an outer surface of a connector body.
Figure 9:
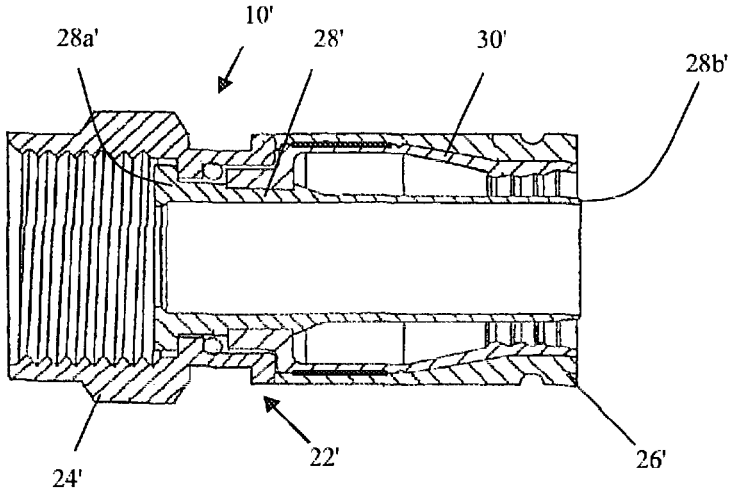
FIG. 9 depicts the coaxial cable connector of FIG. 8 where the cable (not shown) has been inserted and clamped within the connector.

A fourth embodiment of the present invention is shown in FIGS. 8 and 9. FIG. 8 depicts a coaxial cable connector 10' having a compression member 26' configured to slide over the outer surface 31 of outer cylindrical collar 30'. In this instance the adhesive layer 36 of microcapsules 38 (shown in stipple) is located on a portion of outer surface 31 of outer cylindrical collar 30'. As shown in FIG. 9, when installing coaxial cable connector 10' on the prepared end of a coaxial cable (not shown), tubular inner post rear end 28*b'* is first inserted axially into the cable end (not shown). When compression member 26' is compressed onto connector body 22, the ruptured microcapsules 38 form a bond between compression member 26' and connector body 22', thereby creating a desired level of mechanical connection and a moisture barrier.

Figure 10:
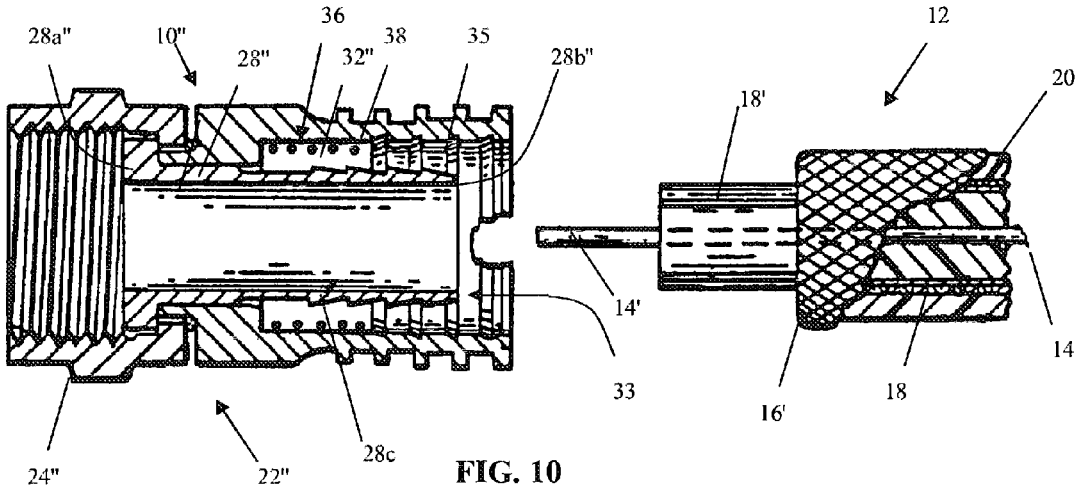
FIG. 10 depicts a cross-sectional view of a coaxial cable connector showing an adhesive layer (shown in stipple) on a connector body internal passageway; and, FIG. 11 depicts the coaxial cable connector of FIG. 10 where the coaxial cable has been inserted and crimped within the connector.
Figure 11:
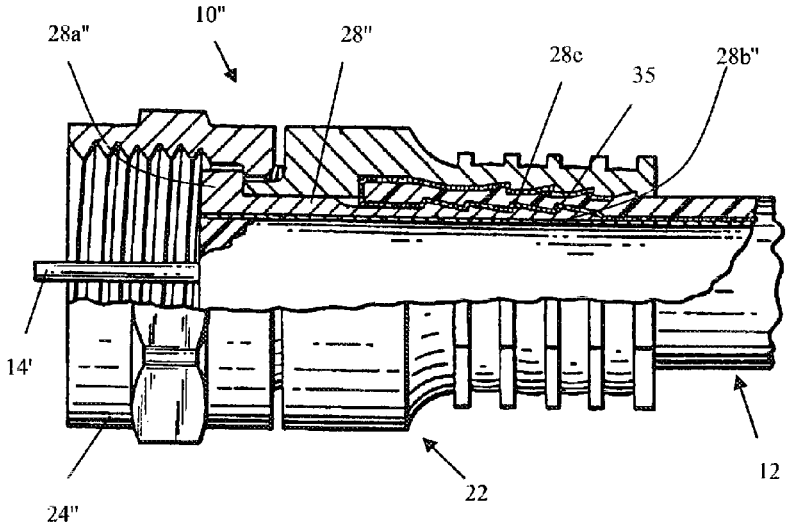

A fifth embodiment of the present invention is shown in FIGS. 10 and 11. FIG. 10 depicts a "crimp style" coaxial cable connector 10" with a connector body 22". A tubular inner post 28" with a tubular inner post front end 28*a"* and a tubular inner post rear end 28*b"* is disposed within connector body internal passageway 33. Connector body internal passageway 33 has a series of connector body grooves 35. Tubular inner post 28" has a series of tubular inner post grooves 28*c*. A cylindrical fastener 24" is rotatably coupled to one end of connector body 22". An adhesive layer 36 of microcapsules 38 (shown in stipple) may be located on a forward portion of connector body internal passageway 33 (as shown), and/or it can be placed in the portion having grooves 35. As shown in FIG. 11, when installing coaxial cable connector 10" on the prepared end of coaxial cable 12, the tubular inner post rear end 28*b"* is first inserted axially into the cable end. Any contact of the coaxial cable 12 with the connector body internal passageway 33 is minimal and the microcapsules 38 of adhesive layer 36 remain intact. A standard tool (not shown) is then used to crimp the connector body 22". During the crimping operation, coaxial cable 12 is gripped between the connector body grooves 35 and tubular inner post grooves 28*c*. As a result, the ruptured microcapsules 38 form a bond between the coaxial cable 12 and connector body 22", thereby creating a mechanical connection and a moisture barrier.

In addition to the embodiments discussed above, microcapsules 38 can be placed in combination on the multiple surfaces of the connector body 22 or compression member 26. Such a combination would form adhesive layers 36 between both the connector body 22 and compression member 26, the coaxial cable 12 and compression member 26, and the connector body 22 and the coaxial cable 12. This invention encompasses the combination of any embodiments where microcapsules 38 are placed in any number of configurations on the components of a coaxial cable connector.

Any reference to either direction or orientation in the above description is intended primarily and solely for purposes of illustration and is not intended in any way as a limitation to the scope of the present invention. Also, the particular embodiments described herein, although being preferred, are not to be considered as limiting of the present invention.

I claim:

1. A compression member for a coaxial cable connector having a first compression member end and a second compression member end, the compression member having a compression member internal passageway defined therein, the compression member internal passageway configured to receive a coaxial cable; the compression member further having an adhesive layer comprising microcapsules of an adhesive material, wherein axial compression of the compression member toward a connector body of the coaxial cable connector secures the cable to the compression member and positions the adhesive layer into contact with a surface of the connector body to seal the compression member to the connector body.

2. The compression member of claim 1, comprising a second adhesive layer on a portion of an outer surface of the compression member.

3. A compression member for a coaxial cable connector having a first compression member end and a second compression member end, the compression member having a compression member internal passageway defined therein, the compression member internal passageway configured to receive a coaxial cable, the compression member having a compression member external surface defined thereon, the compression member external surface further having an adhesive layer comprising microcapsules of an adhesive material, wherein axial compression of the compression member toward a connector body of the coaxial cable connector secures the cable to the compression member and positions the adhesive layer of the external surface of the compression member into contact with an internal surface of the connector body to seal the compression member to the connector body.

* * * * *